US006426475B2

(12) United States Patent
Watanabe et al.

(10) Patent No.: US 6,426,475 B2
(45) Date of Patent: Jul. 30, 2002

(54) VACUUM VALVE

(75) Inventors: Kenji Watanabe; Kumi Uchiyama, both of Tokyo; Kiyoshi Kagenaga, Tokoy; Junichi Sato, Tokyo; Eiji Kaneko, Tokyo; Mitsutaka Honma, Tokyo; Hiromichi Somei, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/880,035

(22) Filed: Jun. 14, 2001

Related U.S. Application Data

(62) Division of application No. 08/836,520, filed on Jun. 9, 1997.

(30) Foreign Application Priority Data

Sep. 4, 1995 (JP) ..... 7-226431

(51) Int. Cl.[7] ..... H01H 33/75
(52) U.S. Cl. ..... 218/118; 218/123; 218/128
(58) Field of Search ..... 218/118, 120, 218/123–128

(56) References Cited

U.S. PATENT DOCUMENTS 3,622,724 A * 11/1971 Sofianek ..... 218/118
3,852,555 A * 12/1974 Schuocker et al. ..... 218/118
3,953,694 A 4/1976 Bernard et al.
4,196,327 A 4/1980 Kurosawa et al.
4,367,382 A 1/1983 Suzuki et al. ..... 218/118
4,430,536 A 2/1984 Kurosawa et al.
4,446,346 A 5/1984 Kashimoto et al. ..... 218/118
4,473,731 A * 9/1984 Yorita ..... 218/123
4,588,879 A * 5/1986 Noda et al. ..... 218/118
5,099,093 A 3/1992 Schels et al. ..... 218/146
5,804,788 A 9/1998 Smith et al. ..... 218/129

* cited by examiner

*Primary Examiner*—Lincoln Donovan
(74) *Attorney, Agent, or Firm*—Foley & Lardner

(57) ABSTRACT

The flux density Bct is applied at the center area of the electrode. The flux density Bct is adjusted within the range A of 0.75 to 0.9 times greater than the axial flux density Bcr which gives the lowest arc voltage between the electrodes against each breaking current. The axial flux density monotonously increases from the center to the circumferential area of the electrode. Here, the radial position where the axial flux density Bcr which gives the lowest arc voltage Vmin is adjusted within the region B of 20% to 40% of the radius of the electrode. The axial flux density is made monotonously increase in an outer area from the region B and give the maximum value Bp in a circumferential area equal to or beyond 70% of the radius of the electrode. The maximum value Bp is adjusted within the range C of 1.4 to 2.4 times greater than the flux density Bct given at the electrode center.

10 Claims, 13 Drawing Sheets

A: CONVENTIONAL ELECTRODE

B: FLAT ELECTRODE

C: MODEL ELECTRODE

VACUUM VALVE

This Application is a Divisional of application Ser. No. 08/836,520, filed on Jun. 9, 1997. which is a 371 of PCT/JP96/02498 filed Sep. 4, 1996.

TECHNICAL FIELD

This invention relates to a vacuum valve.

BACKGROUND ART

Generally, in order to improve a breaking efficiency of a vacuum valve, an arc control method of applying a magnetic field parallel to a vacuum arc generated between electrodes has been used to suppress the arc. A typical vacuum valve using the method is a longitudinal-flux-type vacuum valve. One of electrode structures of the longitudinal-flux-type vacuum valve is shown in FIG.11. FIG.11 shows a structure of a movable electrode. A structure of a stationary electrode is the same with the structure of the movable electrode and the stationary electrode is arranged to face the movable electrode for contacting thereto.

In FIG. 11, a round concave 6*a* is dug at a top of a movable conduction element 6B of copper. A ring-shaped reinforcing element 18 of stainless steel has a collar 18*a* of its lower portion and the collar 18*a* is engaged in the round concave 6*a* and brazed to it. A bush 14*a* of copper projecting from a center of a coil electrode 14 is inserted around the collar 18*a* and brazed with the collar 18*a* and the movable conduction column 6B.

Four arms 14*b* projects from the bush 14*a* in a radial pattern as to space 90° each other around the bush 14*a* and in the direction perpendicular to the axial direction of the bush 14*a*. A base portion of an arc coil element 14*c* is brazed to each end of the arms 14*b*. A through hole 14*d* is bored at a top of the coil element 14*c* along the axial direction. A disk-shaped contact element 13 made of copper and having a center column is provided to the top of the coil element 14*c* and the center column of which is inserted into the top of the coil element 14*c* and is brazed thereto.

A disc-shaped electrode plate 2B made of copper with grooves cut in a radial pattern from the center to the circumference thereof is provided on the end of the reinforcing element 18 and that is brazed to the surfaces of the reinforcing element 18 and the contact element 13. A disc-shaped contact element 1A made of tungsten alloy with grooves cut in a radial pattern from the center to the circumference thereof and with a roundly chamfered outer edge is brazed to the electrode plate 2B.

In this vacuum valve having the electrode of the structure set forth above, a breaking current from the movable conduction column 6B to the contact element 1A mainly flows from the bush 14*a* through the arms 14*b* to the end of the coil element 14*c* of the coil electrode 14 and the small part of the current flows through the reinforcing element 18 to the electrode plate 2B.

The current flowing into the coil element 14*c* runs there half round so as to produce a longitudinal magnetic field and flows into the electrode plate 2B via the contact element 13 at the end of the coil element 14*c* and the lower surface of the electrode plate 2B. The current further runs through the upper surface of the electrode plate 2B and comes out from the contact element 1A. This current coming out from the contact element 1A flows into a contact element of the stationary electrode (not shown in FIG. 11) contacting to the surface of the contact element 1A and it runs through an electrode plate, a contact element and coil element of the stationary electrode and flows out into a stationary conduction column.

FIG. 12 shows a distribution of magnetic flux density between the electrodes produced by the coil electrode 14 (given at an area halfway between the movable and stationary electrodes when they are pulled apart). The longitudinal flux density between the electrodes is greatest at the center area of the electrode and it gradually lowers toward the circumference thereof. Here, in order to effectively suppress an eddy current to be generated by the coil electrode 14, slits are made in the electrode plate 2B and the contact element 1A. The coil electrode 14 is designed as the flux density to be larger even at the circumference of the electrode than a flux density Bcr which causes the lowest arc voltage to respective breaking currents.

By controlling the vacuum arc generated between the electrodes through this distribution of flux density, the breaking current that causes an arc concentration is greatly improved comparing to that to be caused under the condition without the magnetic field, and the breaking efficiency is also greatly improved. However, it does not mean that the arc concentration can be prevented to the indefinitely great current under the condition that the diameter of the electrode is defined. The arc concentration tends to occur in the center area of the electrode (in the neighborhood of an anode) in a strong magnetic field that is produced by a greater current than a critical value.

Additionally, as shown in FIG. 12 of the distribution of the magnetic flux density, the current density in the center area of the electrode has been detected very great even in the lower current region than the critical current. This tends to cause the current density in the center area to reach to the critical current density so that the arc shifts from its dispersed state to concentrated state and finally falls into non-breakable state.

In order to raise the critical current, it seems to be effective to unify the distribution of current density by changing the magnitude and the distribution of flux density to be adjusted. However, as to the intensity of the magnetic field, the inventors carried out current-breaking tests by using trial electrodes enabling to produce intensified magnetic fields but the result did not show the effectiveness.

Accordingly, the distribution improvement of flux density has been expected to be a solution for raising the critical current and there has been proposed several methods in line with this approach in the past. Here, one typical method for improving the distribution of flux density will be explained.

FIG. 13 shows curves of radial-direction distribution of flux density between the electrodes, which is cited from the paper (IEEE Transs. on Power Delivery, Vol. PWTD-1, No. 4, Oct. 1986) presented by the inventors. These curves show that, although the distribution of flux density differs according to the gap distance between the electrodes, the maximum value of flux density always appears at the circumferential side of the electrode. However, the maximum density in the radial direction appears at around 55% point of the radius 28.5 mm of the electrode and it is out of the scope of the distribution characteristic of flux density proposed by this invention. Further, the conventional distribution characteristic of flux density can not effectively disperse the arc generated between the electrodes to their circumferential areas.

There are three kinds of method known which can lower the flux density in the center area of the electrode.

(1) One of which is a method of producing a reverse magnetic field by an eddy current flowing the electrode plate and contact element by not cutting the slits in the electrode plate 2B and the contact element 1A.

(2) Other method is that provides an other coil electrode for producing the reverse magnetic field in the center area of the electrode.

(3) The third method is that brings the coil electrodes 14 of the movable side and the stationary side closer as possible.

Japanese Laid Open Application PS57-212719 discloses an electrode structure using the method (1). FIG. 14(*a*) shows a distribution of flux density of this electrode and FIG. 14(*b*) shows the structure of the electrode. A coil electrode 11 is joined to an end of a movable conduction column 6C and a join port 15 is made therein and a spacer 18 is joined in the center area thereof. An electrode plate 12 is joined to the coil electrode 11 via the join port 15 and the spacer 18. A field adjust plate 36 of pure copper is buried in a surface 35 of the electrode plate 12 so as the reverse magnetic field to be produced by the eddy current generated by this field adjust plate 36. A contact element 37 is joined on the upper surface of the field adjust plate 36.

The distribution of flux density produced by this vacuum valve of the structure is shown by curved line F2 in FIG. 14(*a*). In FIG. 14(*a*), dotted line F1 shows a distribution of flux density produced by an electrode having no such a field adjust plate like the plate 36. As can be seen from FIG. 14(*a*), the maximum density of the flux comes to appear at the circumferential area by the reverse current generated by the field adjust plate 36, but the radial position of the maximum density is about 40% of the radius of the electrode and it is out of the scope of this invention.

Although it does not aim to improve the distribution of flux density, Japanese Patent Publication PH4-3611 shows an electrode which produces the similar distribution of flux density. FIG. 15 shows the structure of the electrode and the characteristic of the distribution of flux density produced by the electrode. In this structure, when a coil 31 provided at an external place of an electrode 32 for producing a magnetic field is energized, the distribution of flux density of the electrode 32 becomes like a curved line G2 by an eddy current generated by a contact element 1B and the point of the maximum flux density appears at the circumference of the electrode 32. In this FIG. 15, a dotted curve G1 shows a distribution characteristic of flux density produced solely by the coil 31.

It is impossible to conclude since there is not shown concrete numerical values in its publication. But judging from the position giving the maximum value and the ratio of the density values between the maximum point and the center area, it seems to fall in to the scope of this invention.

However, judging from the description of the publication it is out of the scope of this invention because the description expresses that the flux density of the center area of the electrode was greatly lowered and the longitudinal magnetic field did not effectively affect and further, the flux density of the center area of the electrode is apparently lower than the flux density aimed by this invention. Furthermore, as can be seen from FIG. 15, the flux density of the circumferential end of the electrode is drawn to near zero and it can not satisfy the criteria of the condition as the conventional art corresponding to this invention (the flux density should be equal to or greater than 2 mT/KA at the circumferential end of the electrode).

Japanese Laid Open Application PS57-20206 discloses an electrode structure using the method (2) set forth above. FIG. 16 shows a characteristic of a distribution of flux density between electrodes using the method (2). In the distribution of flux density shown in FIG. 16, the position giving the maximum flux density seems to fall in to the scope of this invention. However, the flux density produced by a coil for generating magnetic field at the center area of the electrode is reverse and the value at the center area of the electrode differs from that required by this invention.

Several other proposals which disclose electrode structures for producing reverse magnetic field at the center area thereof are found. However these proposed structures differ from this invention because they all produce the magnetic field of the reverse direction at the center area of the electrodes.

Japanese Patent Publication PH2-30132 discloses an electrode structure using the method (3). FIG. 17 shows a distribution characteristic of flux density between electrodes using the method (3). Compared to the method (2), the flux density at the center area of the electrode is not minus and the radial position giving the maximum flux density seems to fall in to the scope of this invention. However, the maximum value of flux density is about 2.5 times greater than that of given at the radial position 40% from the center of the electrode and this characteristic is out of the scope of this invention. Further, an axial flux density distribution from the center to the circumference of the electrode is not monotonously increasing and at this point, it differs from this invention.

In the conventional vacuum valve, as set forth above, there is drawback that the arc generated tends to concentrate to the center area of the anode since the flux density of the center area of the electrode is too great or too small. Additionally, since the arc tends to concentrate at one area, the energy density becomes too high when the arc flows into the surface of the anode. Therefore, the surface of the electrode sustains great heat damages and the temperature of the surface is kept high during the current breaking, and this makes the current breaking unable.

SUMMARY OF INVENTION

One of the objects of this invention is to provide a vacuum valve which can raise the critical current that starts the arc concentration by means of unifying the flux density along the surface of the electrode.

Other object of this invention is to provide a vacuum valve which improves the efficiency of current breaking by means of making the arc concentrate to plural points on the circumferential area of the electrode so as to decrease the current density at the area where the arc current is concentrating even if the current density on the surface of the electrode becomes higher than the critical current value and begins to concentrate.

Generally, voltage drop Vcolm in an arc column relates to axial flux density Bz and current density Jz as expressed below.

$$\text{Vcolm } Jz/Bz \quad (1)$$

Therefore, if the flux density is high at the center area of an electrode, the voltage drop Vcolm tends to decrease even when a current of the same density flows. As the degree of the voltage drop Vcolm between the electrodes is constant on the whole surface of the electrode and balances with the Vcolm on the circumferential area of the electrode, the current density Jz becomes high at the center area where the flux density is also high. This results in, in the conventional art, that the current density between the electrodes becomes high in the center area thereof as same as the flux density and it gradually decreases toward the circumference thereof as shown in FIG. 12.

In order to unify the current density over the surface of the electrode, it is necessary to suppress the current density in the center area of the electrode and to increase the current density at the circumferential area thereof. Accordingly, in order to suppress the current density in the center area of the electrode, this invention proposes to lower the axial flux density in the center area and to make the voltage drop large in the arc column at the center of the electrode so as to make the current flow uneasily. By using this method, the flux density of the circumferential area of the electrode becomes relatively high compared to the flux density in the center area thereof so as to make the voltage drop in the arc column become small and the current flow easily. The vacuum arc is carried its current mainly by an electron flow and, in the region of flux density intensified, Lamor radius is small and the arc is effectively captured by the magnetic line of force. As a result, the current comes to steadily flow in the circumferential area of the electrode which producing strong magnetic field and it becomes possible to unify the current density between the electrodes compared to the conventional art.

Further, in order to prevent the arc from concentrating to the center area of the electrode when the current increases greater than the critical current value, plural areas where the current density becomes slightly high are provided by means of changing the strength of flux density along the circumferential direction of the electrode, and this makes the arc concentrate to the plural areas respectively and decentralized. As a result, the arc comes to concentrate at plural areas and the current density of each area can be suppressed lower than that of the conventional art where the arc tends to concentrate at one spot.

In order to achieve this object, a first aspect of the invention is a vacuum valve characterized by producing an axial magnetic field parallel to an arc generated between a movable and a stationary electrodes facing each other, and being adjusted a magnitude of an axial flux density between the electrodes to increase gradually from a center area toward a circumferential area of each electrode, a point giving a maximum value (Bp) of the axial; flux density to appear at a location equal to or outer than 70% of a radius from the center of each electrode, and the maximum value (Bp) in a radial line from the center to the circumferential end as to be 1.4 to 2.4 times greater than a flux density of the center (Bct) of each electrode.

An invention claimed in claim 2 is a vacuum valve for producing an axial magnetic field parallel to an arc generated between a movable and a stationary electrodes facing each other, and adjusting a magnitude of an axial flux density between the electrodes to increase gradually from a center area toward a circumferential area of each electrode, a point giving a maximum value (Bp) of the axial flux density to appear at a location equal to or outer than 70% of a radius from the center of each electrode, and the maximum value (Bp) of the axial flux density in a radial line from the center to a circumferential end to be 1.05 to 2.16 times greater than an axial flux density (Bcr) which is produced when an arc voltage becomes the lowest (Vmin) according to a relationship between the arc voltage and the axial flux density, where the arc voltage is defined by the radius of each electrode and a breaking current.

An invention claimed is a vacuum valve in which an axial flux density of the circumferential end of each electrode to be equal to or greater than 2 mT/KA.

A second aspect of the invention is a vacuum valve characterized by the flux density (Bct) of the center of each electrode being adjusted as to be 0.75 to 0.9 times greater than a flux density (Bcr) which is giving the lowest arc voltage (Vmin).

A third aspect of the invention is a vacuum value characterized by a radial position producing the flux density (Bcr) according to the lowest arc voltage being adjusted to locate within 20% to 40% area of the radius of each electrode.

A fourth aspect of the invention is a vacuum valve characterized by proving plural portions on a circular line passing through a radial point on each electrode at which the maximum flux density (Bp) is to be produced, where flux densities are to be 0.6 to 0.9 times greater than the greatest value (Bmax) among the maximum flux densities (Bp).

A fifth aspect of the invention is a vacuum valve characterized by a distribution of an axial flux density along the circular line passing through the radial point on each electrode at which the maximum flux density (Bp) is produced being adjusted as to have more than half portion of the circular line where, when the greatest value of flux density is set as Bmax and the smallest value of flux density as Bmin among the maximum flux densities (Bp), the flux density to be produced is greater than (Bmax+Bmin) /2.

A sixth aspect of the invention is a vacuum valve having a pair of electrodes each of which is accommodated in a vacuum chamber and joined to a conduction column for electrical connection with an external element and both of which are facing each other for contacting, and characterized by having a contact element on a surface of each electrode, the contact element having a graded characteristic that a degree of a cathode voltage drop continuously or gradually reduces from the center to the circumference thereof.

A seventh aspect of the invention is a vacuum valve characterized by the contact element being made of copper-chrome (CuCr), and a weight percent of the chrome therein being adjusted to increase gradually from the center area to the outer side.

An eighth aspect of the invention is a vacuum valve comprising a vacuum chamber, a conduction column in the vacuum chamber, a pair of electrodes each of which is accommodated in the vacuum chamber and joined to the conduction column for electrical connection with an external element and both of which are facing each other for contacting, a central conduction coil for producing the longitudinal magnetic field provided behind a central portion of each electrode, a plurality of peripheral conduction coils having a similar characteristic to the central conduction coil behind each electrode for producing the longitudinal magnetic field, and a current restraining member inserted between a top surface of the central conduction coil and each electrode.

An invention claimed in claim 9 is a vacuum valve comprising a vacuum changer, a conduction column in the vacuum chamber, a pair of electrodes each of which is accommodated in the vacuum chamber and joined to the conduction column for electrical connection with an external element and both of which are facing each other for contacting, a plurality of conduction studs provided at peripheral positions in a rear side of each electrode, a plurality of magnetic members respectively provided adjacent to each conduction stud for being magnetized by a magnetic field produced by each conduction stud.

BRIEF DESCRIPTION OF DRAWINGS

FIG. 14(*b*) shows a view of the electrode on the third conventional vacuum valve.

BEST MODE FOR CARRYING OUT THE INVENTION

Figure 1:
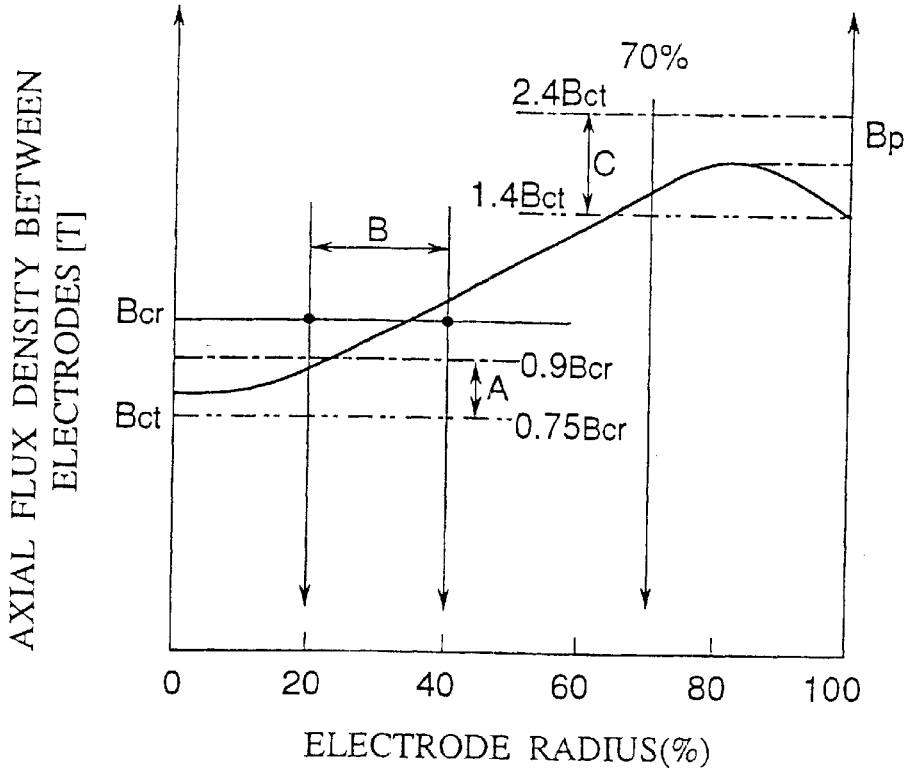
FIG. 1 shows a distribution of an axial flux density between electrodes given along radial direction of the electrodes in the first embodiment of this invention.
Figure 2:
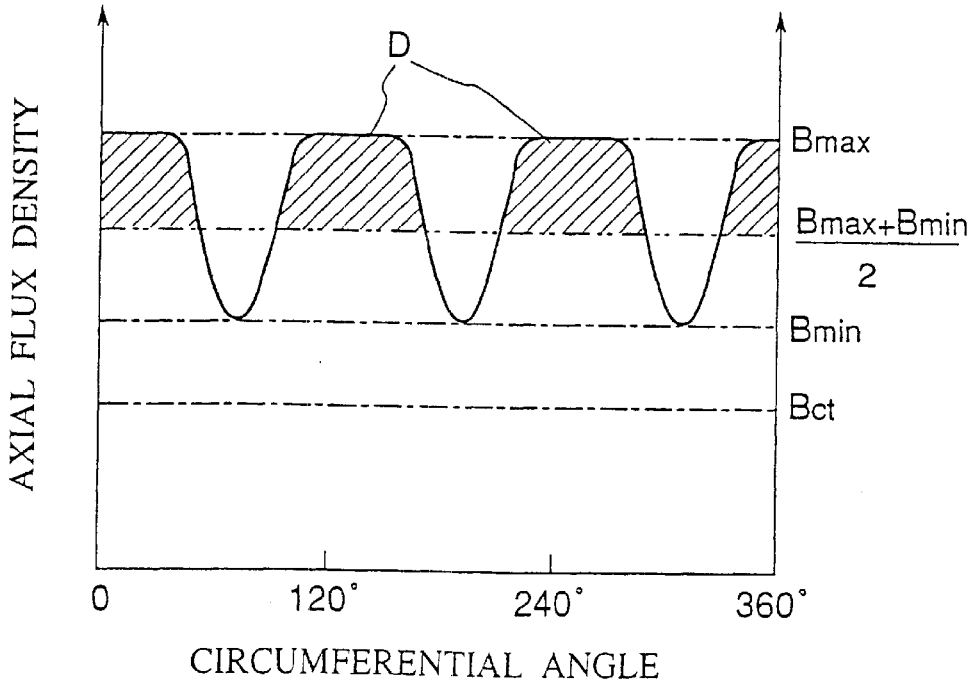
FIG. 2 shows a distribution of the axial flux between the electrodes given along circumferential direction of the electrodes in the first embodiment.
Figure 5:
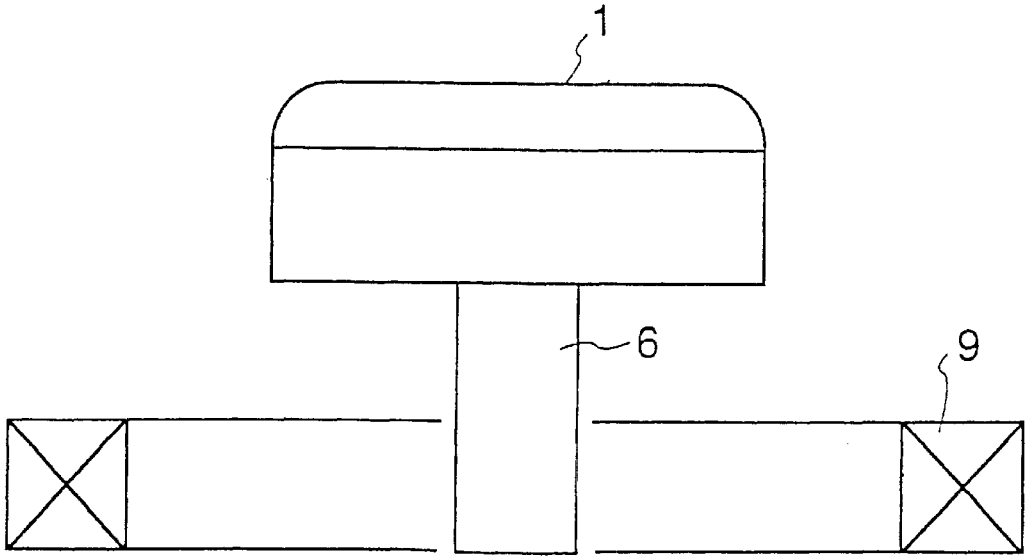
FIG. 5 shows a view of a general flat electrode.

Hereinafter, the embodiments of this invention will be explained with referred to the drawings. FIG. 1 shows a distribution of an axial flux density between electrodes given along a radial direction of the electrodes of the first embodiment of this invention of a vacuum valve. The invention realizes the distribution of flux density that gives a low axial flux density Bct at the center of the electrode and increases gradually toward the circumference of the electrode, and it gives the maximum value Bp at the near point to the outer-most of the electrode by using a structure of electrode as shown in FIG. 5 FIG. 2 shows a distribution characteristic of the axial flux density given along the circle passing the radial point of the vacuum valve of this invention, where the point gives the maximum value Bp. Here the distribution characteristic gives three concavities and convexities along the circle. The characteristic will be precisely explained after.

Figure 3:
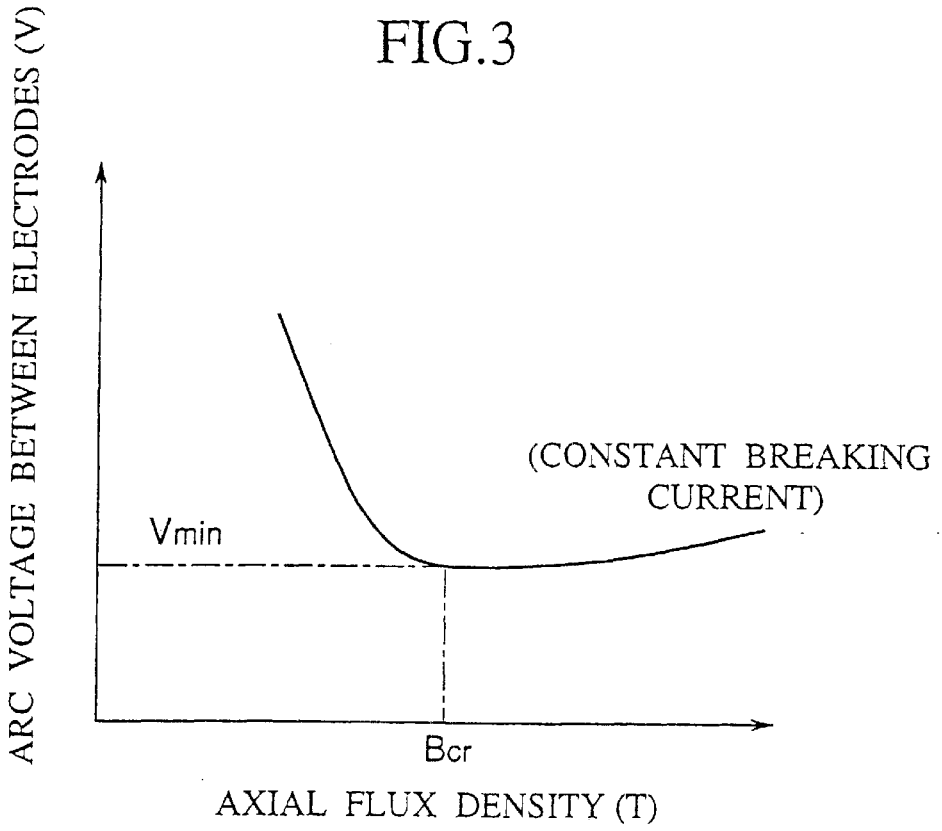
FIG. 3 shows a relationship between an arc voltage produced between the electrodes and the axial flux density in the first embodiment.

First, a relationship between an arc voltage between the electrodes and the distribution of the axial flux density will be explained. Generally, if a radius of the electrode and a breaking current are defined, then the relationship of the arc voltage between the electrodes with the distribution of the axial flux density shows a characteristic as shown in FIG. 3. If the axial flux density is changed, there can be found a point of flux density Bcr that gives the lowest arc voltage Vmin. Here, the flux density itself changes according to the breaking current, the radius of the electrode and materials of a contact element, but the tendency of the characteristic is common.

Taking this characteristic into account, as shown in FIG. 1, this invention of a vacuum valve proposes to apply a flux density Bct at the center area of the electrode. The flux density Bct is adjusted within a range A of 0.75 to 0.9 times greater than the axial flux density Bcr (shown in FIG. 3) which gives the lowest arc voltage between the electrodes against each breaking current. This invention also proposes to monotonously raise the axial flux density from the center to the circumferential area of the electrode. Here, a radial position where the axial flux density Bcr which gives the lowest arc voltage Vmin is adjusted within a region B of 20% to 40% of the radius of the electrode.

The axial flux density is made monotonously increase in an outer area from the region A and give the maximum value Bp in a circumferential area equal to or beyond 70% of the radius of the electrode. The maximum value Bp is adjusted within a range C of 1.4 to 2.4 times greater than the flux density Bct given at the electrode center. Relationships among the flux density Bct of the center of each electrode, the maximum value Bp of the axial flux density and the axial flux density giving the minimum arc voltage Vmin are as below.

Bct/Bcr=0.75 to 0.9

Bp/Bct=1.4 to 2.4

Then, to rewrite these relationships to a relationship between the maximum value Bp of the axial flux density and the axial flux density Bcr which giving the minimum arc voltage Vmin, it is expressed as below.

Bp/Bcr=Bp/Bct*Bct/Bcr

When substitute numerals for the above relationship, the maximum permissible range becomes as below.

BP/Bcr=0.75*1.4 to 0.9*2.4 =1.05 to 2.16.

Further, as shown in FIG. 2, a circumferential distribution of flux density passing the radial position where the axial flux density gives the maximum value is made fluctuate high and low. The circumferential distribution of flux density is adjusted to give at least two peaks on the circle. Here, the greatest value Bmax and the smallest value Bmin in the circumferential distribution of flux density are adjusted within a range of 1.4 to 2.4 times greater than the axial flux density Bct of the electrode center and also adjusted to have a region D equal to or broader than 50% of the circle where a flux density value shows equal to or greater than (Bmax+Bmin)/2.

By adjusting the distribution of the axial flux density between the electrodes as set forth above, as the lower flux density than the flux density Bcr which gives the lowest arc voltage Vmin is produced in the center area of the electrode, a voltage drop in an arc column being energized at the center of the electrode becomes greater than that in the circumferential area of the electrode. Accordingly, the flux density distribution tends to make the degree of the voltage drop in the arc column smaller and equalize with the arc voltage drop in the circumferential area of the electrode. As a result, according to the relationship of the expression (1), the density of the current flowing the center area of the electrode is suppressed to be lower than the density of the current flowing the circumferential area of the electrode.

Additionally, since the axial flux density tends to increase from the center area toward the circumferential area of the electrode as shown in FIG. 1, an arc generation in the circumferential area of the electrode becomes easier than the conventional electrode. For instance, in the case that a contact element made of CuCr is used, since the arc voltage does not rise so high even when the axial flux density becomes higher than the flux density Bcr which gives the lowest voltage Vmin, the arc to be generated can spread widely toward the circumferential end of the electrode. However, when the breaking current increases, the arc voltage goes high in the region of high flux density as the relationship between the arc voltage and the flux density shown in FIG. 3. In order to prevent this phenomenon, it becomes possible to easily generate the arc in the circumferential area of the electrode by using a contact element with a graded characteristic of gradually decreasing the degree of a cathode voltage drop from the center toward the circumference of the electrode. As a result, since the current density in the center area of the electrode is suppressed and the current density in the circumferential area of the electrode is raised, the distribution of current density in the electrode comes to be unified.

Figure 4A:
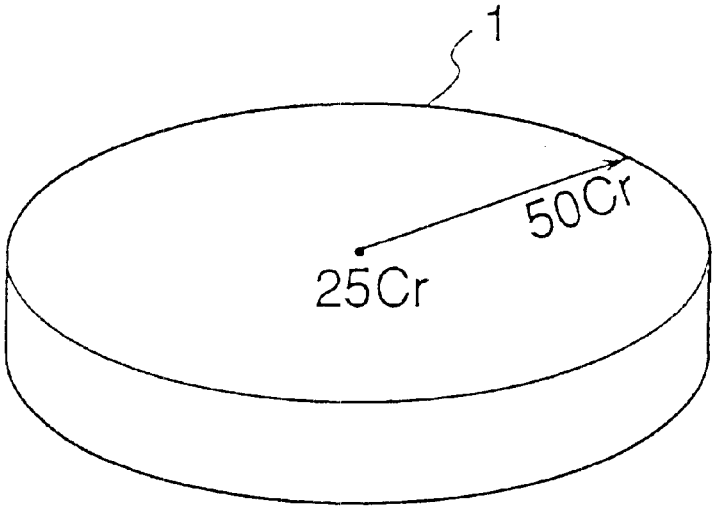
FIGS. 4(*a*), (*b*) respectively show views of a contact element used by the first embodiment.
Figure 4B:
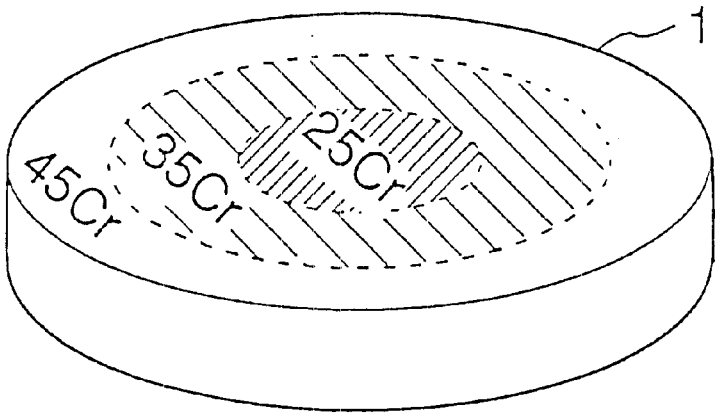

For instance, as shown in FIG. 4(*a*), copper-chrome (CuCr) material is used for the contact element 1, and the element 1 contains chrome of about 25 wt % in the center area and about 50 wt % in the most circumferential area, and the contamination rate of chrome is continuously raised from the center area toward the circumferential area in the contact element. Other usable material for the contact element is that of shown in FIG. 4(*b*), wherein copper-chrome (CuCr) material is used for the contact element 1, and the element 1 contains chrome of about 25 wt %. in the center area, about 35 wt % in the mid area and about 45 wt % in the most circumferential area, that is the contamination rate of chrome is gradually raised by several steps from the center area toward the circumferential area in the contact element.

While the breaking current increases, a shrinking force appears in the arc column toward the center of the electrode around an anode electrode. This is the pinch force produced from mutual action between a circumferential magnetic line of force of the arc column produced by its self-current and the arc current. As a stronger flux than the flux density produced by the conventional arc control is applied to the circumferential area of the electrode, electrons carrying the current are strongly captured by the flux and therefore, the shrinkage of the arc column is to be effectively suppressed.

It is inevitable for the circumferential distribution of the axial flux density of the electrode to have high and low portions, and the current flowing the low flux density area tends to concentrate to the high flux density area as the breaking current increases. Then, in the case that the circumferential distribution of the axial flux density is adjusted to be unified in the circumferential area of the electrode, when the arc starts to concentrate to a certain area the arc tends to concentrate to that area on the electrode. Therefore, it is important to initially make the circumferential distribution of the axial flux density have several high density portions and low density portions. By using this method, when the arc starts to concentrate to the several high density portions on the circumferential area of the electrode along with the current increasing, each magnitude of the current density of the concentrated portions becomes relatively low because the arc does not concentrate to one point like the conventional structure but disperses to the several portions. For this act, the critical current value which starts the arc concentration is effectively raised. Additionally, as the portions of the arc concentration are to be in the circumferential area of the electrode, the area is broader than that in the center of the electrode and the damage caused by the arc energy is to be effectively reduced on the surface of the anode electrode.

Figure 6:
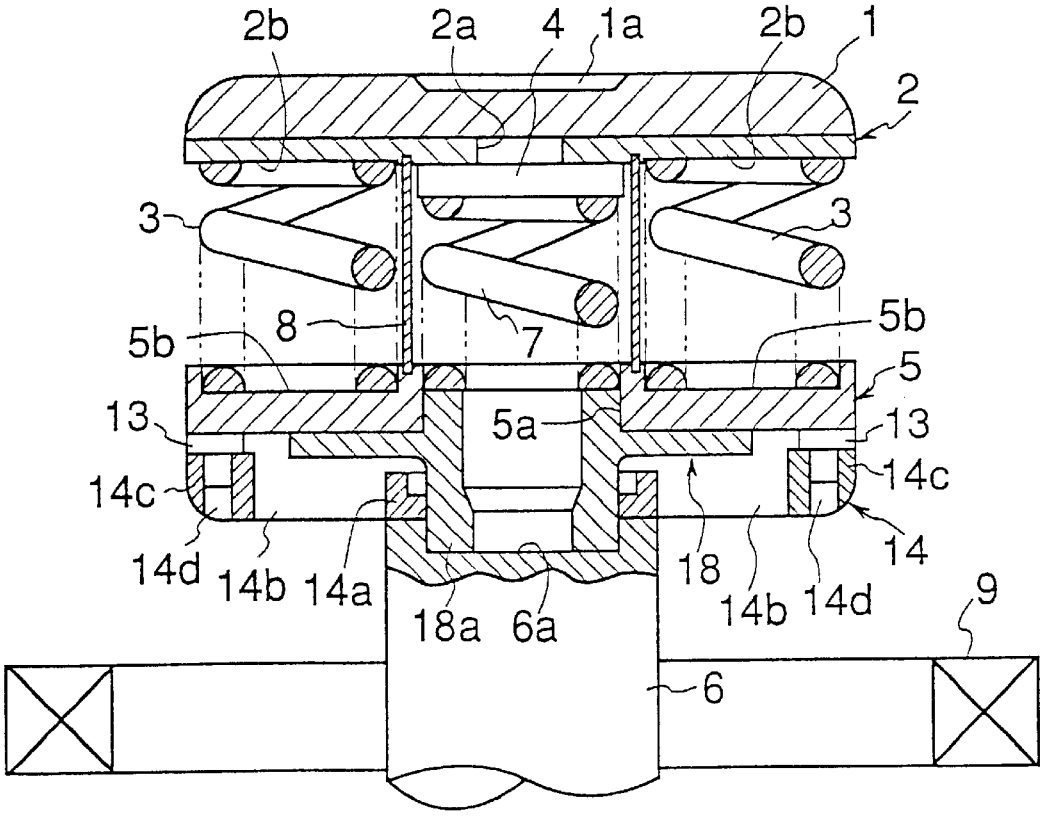
FIG. 6 shows a cross section of the electrode used by the first embodiment.

FIG. 6 shows a model electrode of an embodiment of this invention. Breaking efficiency test was carried out between the model electrode, the conventional electrode of longitudinal magnetic field shown in FIG. 11 and a flat electrode shown in FIG. 5. The flat electrode shown in FIG. 5 is a simplified model of a contact element 1 with a conduction column 6, and an external coil 9 was used for producing a uniform magnetic field between the electrodes under the test.

Figure 11:
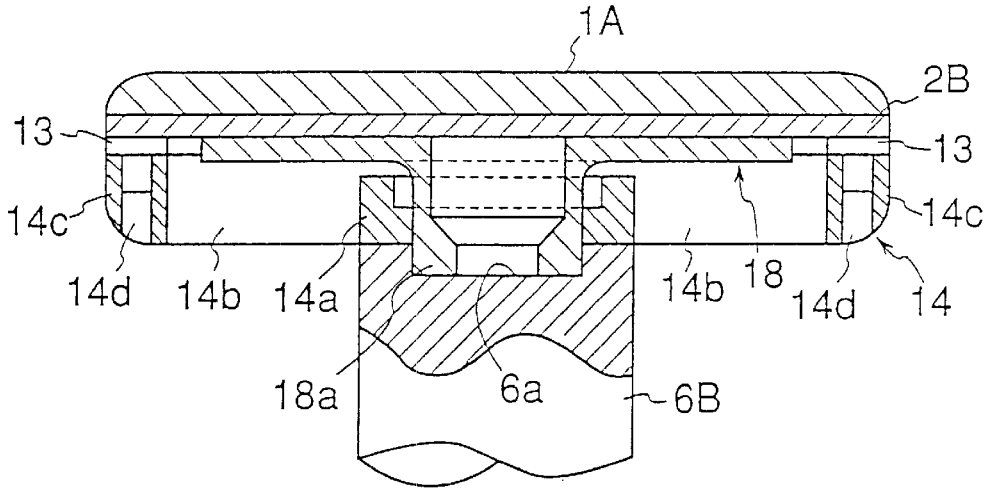
FIG. 11 (PRIOR ART)
FIG. 11 shows a cross section of one of the conventional vacuum valve with a longitudinal magnetic field electrode.
Figure 12:
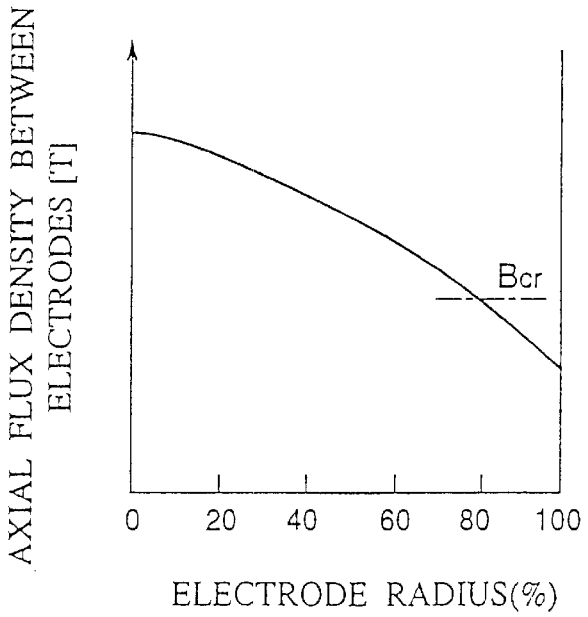
FIG. 12 (PRIOR ART)
FIG. 12 shows a distribution characteristic of flux density of one of the conventional vacuum valves with a longitudinal magnetic field electrode.
Figure 13:
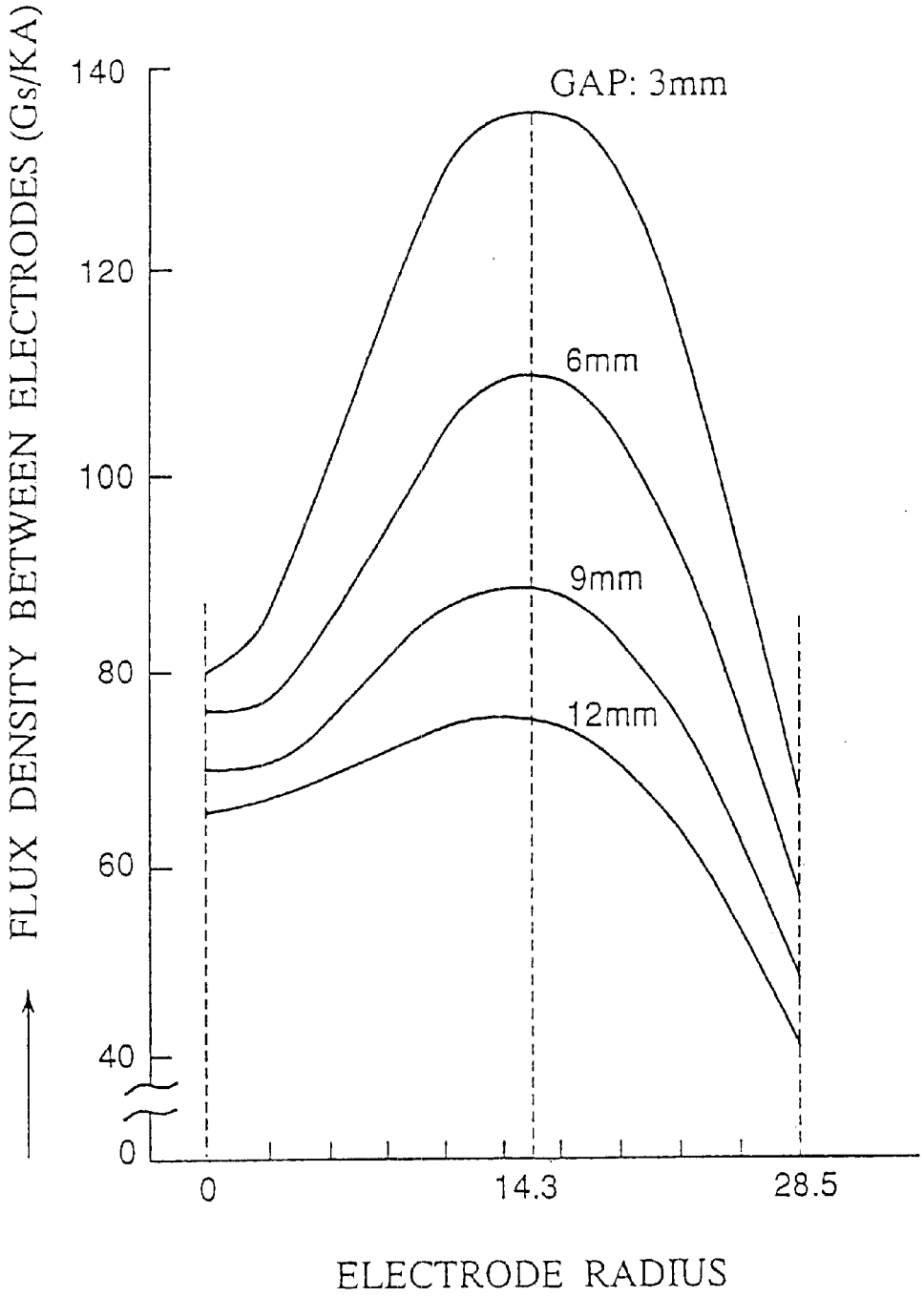
FIG. 13 (PRIOR ART)
FIG. 13 shows a distribution characteristic of flux density of other conventional vacuum valve with a longitudinal magnetic field electrode.
Figure 14A:
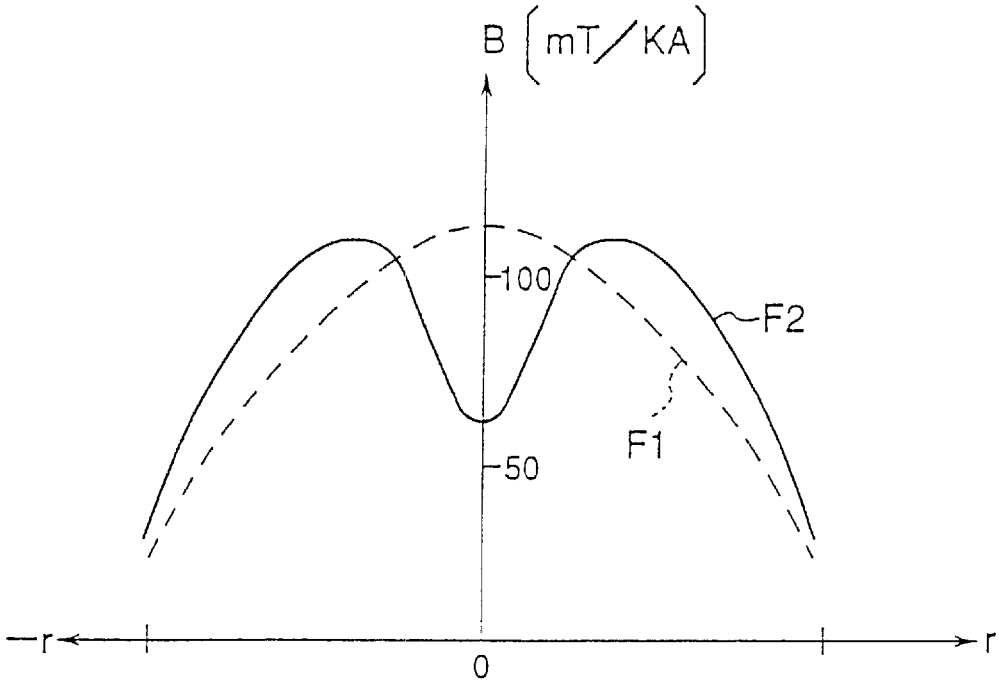
FIG. 14(a) (PRIOR ART)
FIG. 14(*a*) shows a distribution characteristic of flux density of the third conventional vacuum valve with a longitudinal magnetic field electrode.
Figure 14B:
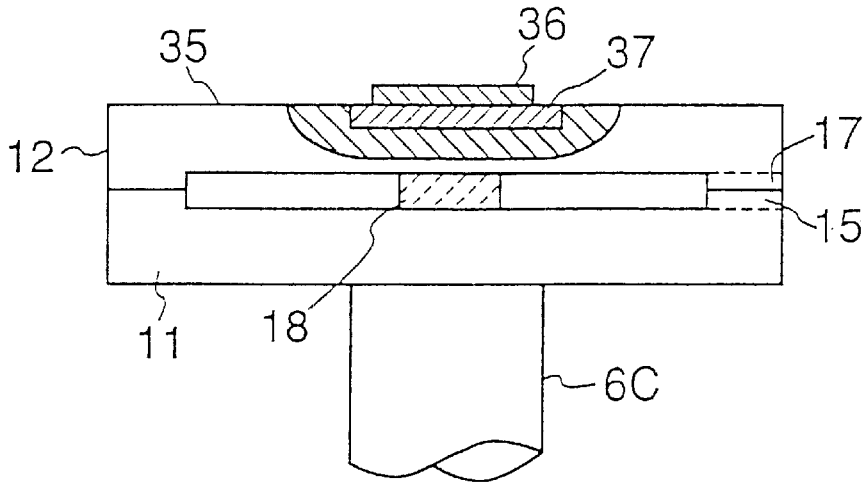
FIG. 14(b) (PRIOR ART)
Figure 15:
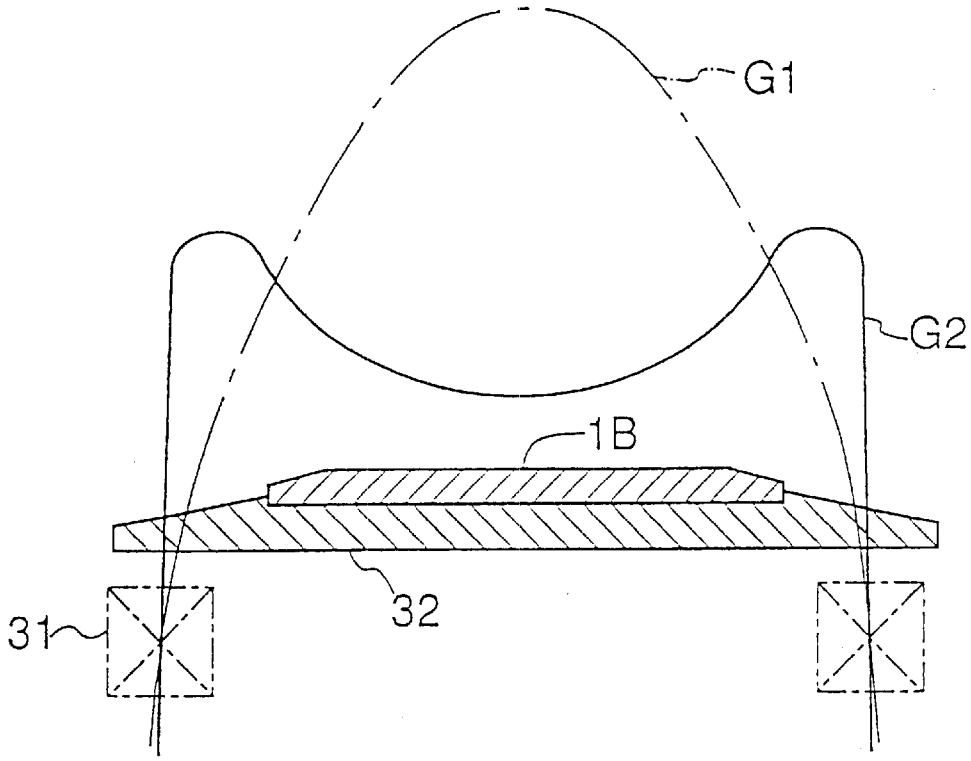
FIG. 15 (PRIOR ART)
FIG. 15 shows a distribution characteristic of flux density of the fourth conventional vacuum valve with a longitudinal magnetic field.
Figure 16:
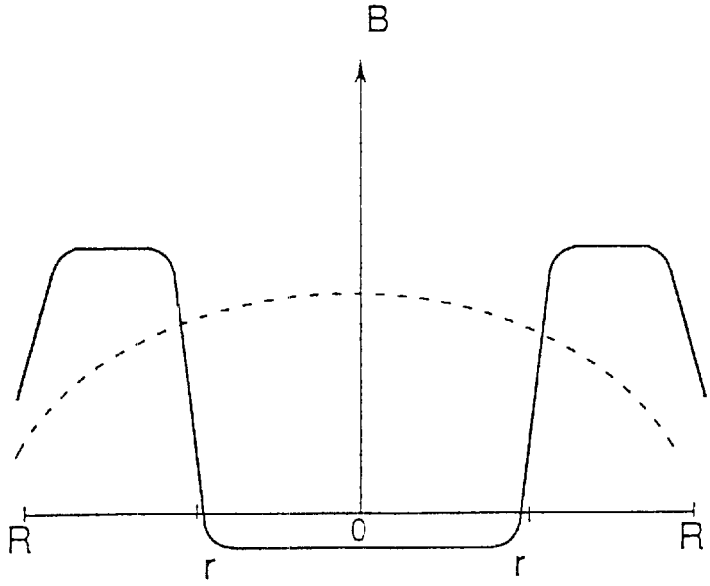
FIG. 16 (PRIOR ART)
FIG. 16 shows a distribution characteristic of flux density of the fifth conventional vacuum valve with a longitudinal magnetic field.
Figure 17:
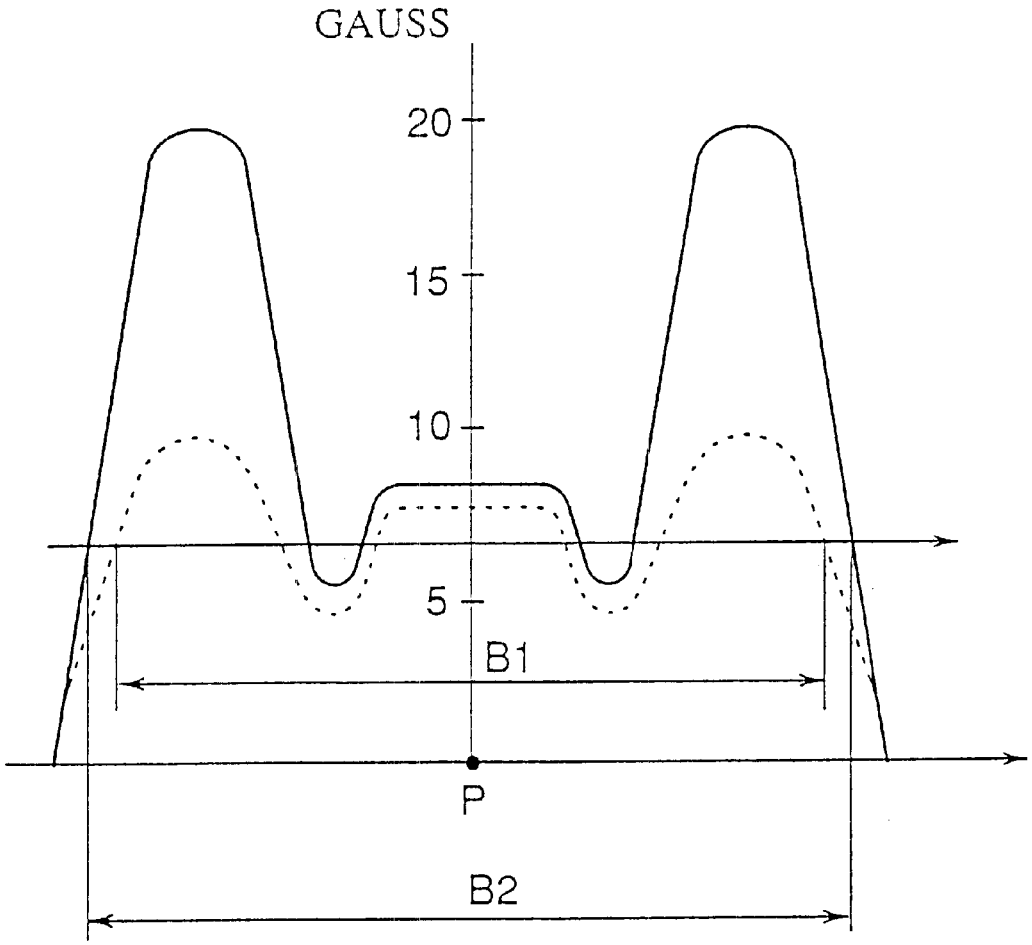
FIG. 17 (PRIOR ART)
FIG. 17 shows a distribution characteristic of flux density of the sixth conventional vacuum valve with a longitudinal magnetic field.

The different point of the model electrode for the vacuum valve of this invention shown in FIG. 6 from the conventional one shown in FIG. 11 is that a coil-shaped copper wire is used for a conducting path of current flow between a contact element and a conduction column in the former model. Other parts of the model are common to those of the conventional electrode shown in FIG. 11.

Hereinafter, the structure of the model electrode shown in FIG. 6 will be explained. A collar 18*a* of a reinforcing element 18 is brazed to the upper end of a movable conduction column 6. A coil support ring 5 made of copper is engaged and brazed with the top of the reinforcing element 18 in a positioning hole 5*a*. A circular narrow groove is cut on the upper surface of support ring 5 and six circular spot-faces 5*b* are dug spacing 60® each other in the circumferential direction.

A center coil 7 made of oxygen-free copper wire is mounted on the upper end of the reinforcing element 18 and brazed thereto. Each of six peripheral coils 3, which is the same with the center coil 7, is mounted in each spot-face 5*b* of the coil support ring 5 and brazed therein. A support cylinder 8 made of stainless steel is inserted at its bottom into the circular narrow groove cut around the positioning hole 5*a* of the coil support ring 5 and brazed therein. An electrode disk plate 2 is mounted on the tops of the support cylinder 8 and the peripheral coils 3. A through hole 2*a* is bored in the center of the electrode plate 2 and a circular narrow groove is cut as to face to the circular narrow groove of the coil support ring 5. The upper end of the support cylinder 8 is inserted into this circular narrow groove of the electrode plate 2 and brazed therein.

Six shallow spot-faces 2*b* are dug on the lower surface of the electrode plate 2. Each spot-face 2*b* has the same diameter with spot-faces 5*b* and is located as to face to each spot-face 5*b* on the coil support ring 5. The top end of each peripheral coil 3 is brazed into each spot-face 2*b*. A projecting portion of a small base element 4 made of stainless steel is inserted into the through hole 2*a* in the center of the electrode plate 2 and brazed therein. The top end of the center coil 7 contacts to the lower surface of the small base element 4 and is brazed thereto.

A diameter of a contact element 1 is the same with the diameter of the conventional contact element 1A shown in FIG. 11. However, a shallow trapezoidal concave 1*a* is dug at the upper center of the contact element 1. The upper circumferential end of the contact element 1 is roundly chamfered.

A vacuum valve constructed from this model electrode works as below. Referring to FIG. 6, most arc current generated between the contact element 1 of the movable electrode and the contact element of the stationary electrode flows from the contact element 1 through each peripheral coil 3 provided between the electrode plate 2 and the coil support ring 5, and the remnant of the arc current flows through the center coil 7. The current flowing through the center coil 7 is about one fourth of the total current flowing through the peripheral coils 3 since the resistance of the small base element affects to regulate the current flowing into the center coil 7. Here, the stationary electrode is not shown in FIG. 6, but it is arranged to face to the movable electrode so that the movable electrode comes to move back and forth against the stationary electrode.

Figure 7:
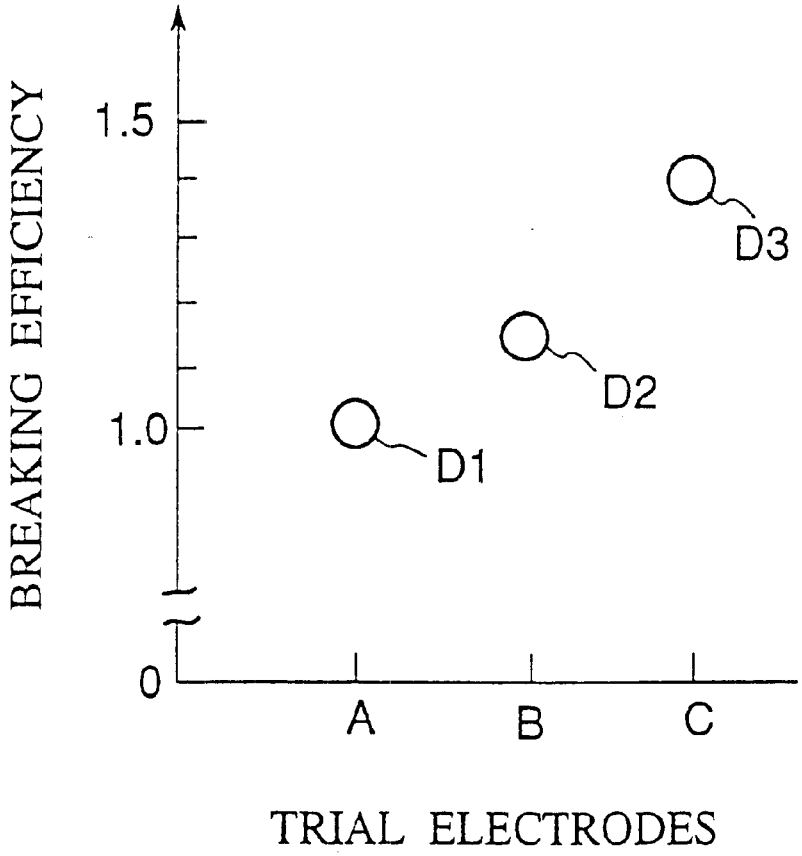
FIG. 7 shows a breaking characteristic of the first embodiment.

As shown in FIG. 7, when the breaking characteristic D1 of the conventional longitudinal magnetic field electrode shown in FIG. 11 is set to 1, then the flat electrode shown in FIG. 5 gives the maximum breaking limit D2 by 1.15 times higher than that of the conventional electrode under the condition that the external coil 9 produces the uniform magnetic field and the strength of the magnetic field produced by the external coil 9 is varied adequately. The model electrode of this invention shown in FIG. 6 gives the maximum breaking limit D3 by 1.4 times higher than that of the conventional electrode and this apparently shows the breaking efficiency is to be improved by this model electrode.

As shown in FIG. 7, when the breaking characteristic D1 of the conventional longitudinal magnetic field electrode shown in FIG. 11 is set to 1, then the flat electrode shown in FIG. 5 gives the maximum breaking limit D2 by 1.15 times higher than that of the conventional electrode under the condition that the external coil 9 produces the uniform magnetic field and the strength of the magnetic field produced by the external coil 9 is varied addequately. The model electrode of this invention shown in FIG. 6 gives the maximum breaking limit D3 by 1.4 times higher than that of the conventional electrode and this apparently shows the breaking efficiency is to be improved by this model electrode.

Figure 8A:
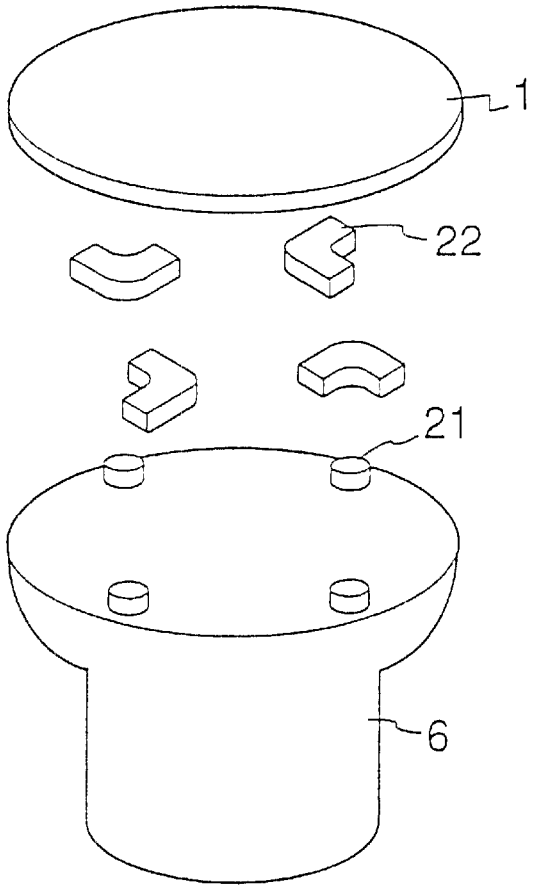
FIG. 8(*a*) shows an exploded view of an electrode used by the second embodiment of this invention and FIG. 8(*b*) shows a plan view of the electrode.
Figure 8B:
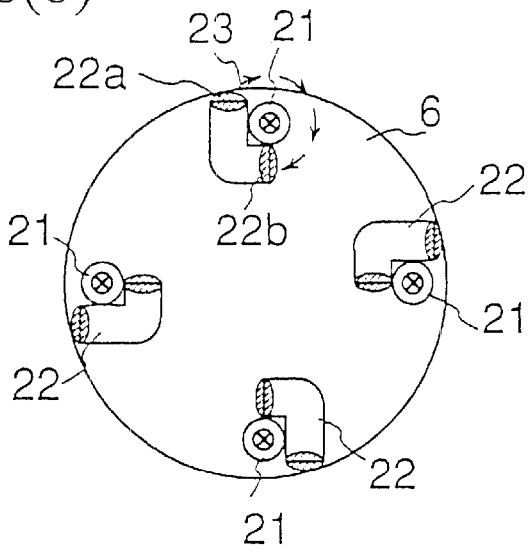

Hereinafter, other structure of an electrode of a vacuum valve of this invention will be explained referring to FIGS. 8 to 10. A structure of an electrode shown in FIG. 8 is also usable in a vacuum valve of this invention as well as that of shown FIG. 6. In the electrode of this embodiment, two or more number of conduction studs 21 of small diameter and magnetic members 22 are arranged between a contact element 1 and conduction column 6. The conduction studs 21 are placed circumferentially on the upper surface of the conduction column 6 and the outer portion of each conduction stud 21 is adjusted as to locate at the point of about 90% from the center in a radial direction of the electrode. Each magnetic member 22 is made as a right angle or an arc-shaped member with an angle of utmost 120° and is arranged around each conduction stud 21.

When the current flows from the conduction column 6 through the contact element 1 and flows into the opposite electrode, the current flows through the respective conduction studs 21 axially. As shown in FIG. 8(*b*), while the current flows the conduction studs 21, a circumferential flux 23 is produced around each conduction stud 21 and this flux 23 passes through each magnetic member 22. Each magnetic member 22 is not ring-shaped but opened and therefore, both ends 22*a* and 22*b* thereof act as magnetic poles. In the opposite electrode (not shown here) having the same structure, the magnetic poles also appear at both ends of each magnetic member. Then axial fluxes are produced between respectively opposing magnetic poles and these axial fluxes act to stabilize the arc generated between the opposing electrodes so that the exhaustion of the contact element 1 is restrained and the breaking efficiency is improved.

By adoption of this electrode of the structure, moreover, it becomes possible to produce the axial magnetic field on the whole surface of the contact element 1 so as to effectively utilize the whole surface thereof. And the electrode shows efficient conductivity as the length of current path is shortened and the resistance between terminals is lowered.

Figure 9A:
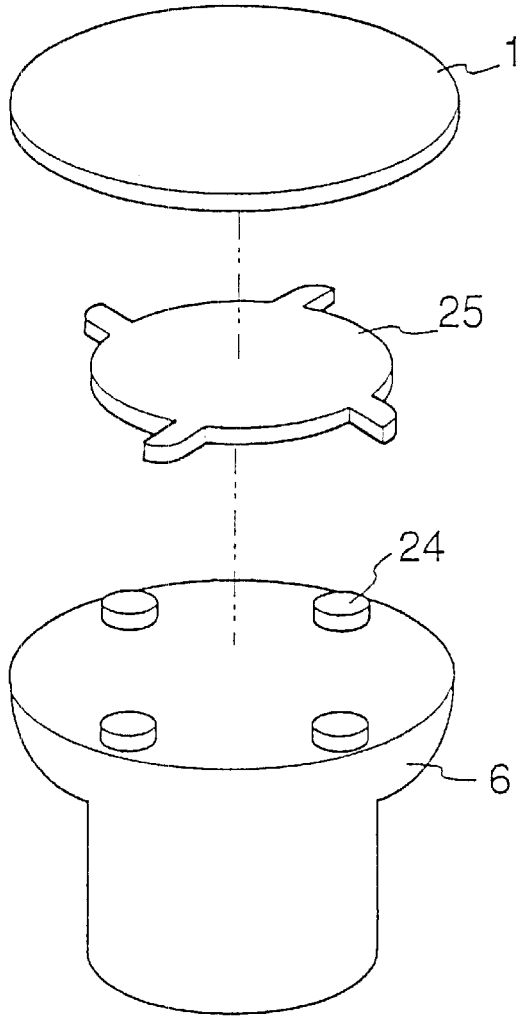
FIG. 9(*a*) shows an exploded view of an electrode used by the third embodiment of this invention and FIG. 9(*b*) shows a partial plan view of the electrode.
Figure 9B:
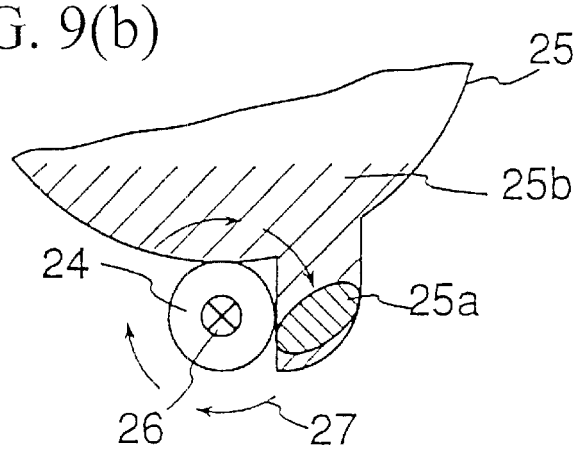

FIG. 9 shows the third embodiment of an electrode structure of this invention of a vacuum valve. In the electrode of this embodiment, plural conduction studs 24 with a small diameter are circumferentially arranged to be spaced each other between a contact element 1 and a conduction column 6. A magnetic member 25 having plural projections 25*a* from its disk body 25*b* is arranged on the top of the conduction column 6 so as each projection 25*a* to locate adjacent to each conduction stud 24.

While a current flows from the conduction column 6 through the contact element 1 into the opposite electrode (not shown here), the current 26 flows through the conduction studs 24 axially. Then, as shown in FIG. 9(*b*), a circumferential flux 27 is produced around each conduction stud 24 and a magnetic pole appears in each projection 25*a* and the reverse magnetic pole appears in the disc body 25*b*. By this phenomenon, as the same with that explained in FIG. 8, axial fluxes are produced between respectively opposing magnetic poles and these axial fluxes act to stabilize the arc between the opposing electrodes so that the exhaustion of the contact element 1 is restrained and the breaking efficiency is improved. In this third embodiment, moreover, construction of an electrode is easier than that of the second embodiment because the magnetic member 25 is of integral construction.

Figure 10A:
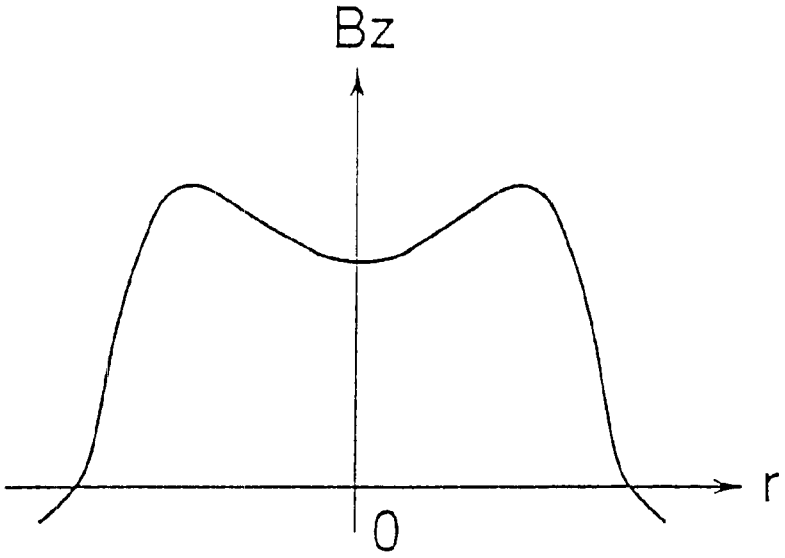
FIG. 10(*a*) shows a distribution characteristic of an axial flux density between electrodes given along a radial direction of the electrodes in the fourth embodiment of this invention and FIG. 10(*b*) shows a view of a magnetic member used by the embodiment.
Figure 10B:
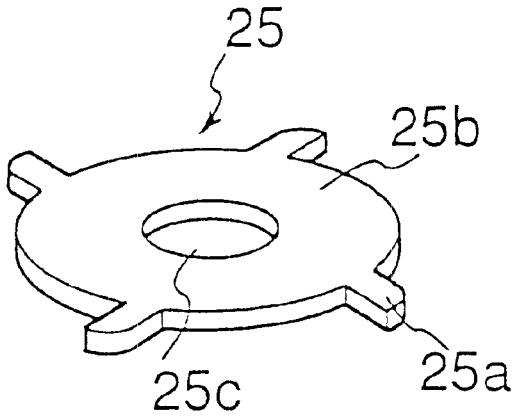

A magnetic member 25 of a construction shown in FIG. 10(*b*) of the fourth embodiment of this invention is usable as the substitute for the magnetic member 25 of the third embodiment shown in FIG. 9. The magnetic member 25 shown in FIG. 10(*b*) is characterized by a disc body 25*b* having a center hole 25*c* which can improve the axial distribution Bz of flux density as shown in FIG. 10(*a*). That is, the center hole 25*c* affects to lower the flux density of the center area of the electrode than that of the circumferential area thereof and to prevent the tendency of arc concentration to the center area of the electrode in breaking a large current, where the arc concentration tends to occur when the flux density is high in the center area. By adoption of this magnetic member 25 of the construction shown in FIG. 10(*b*) to the electrode, accordingly, it becomes possible to broaden the arc over the whole surface of the contact element 1 even in breaking the large current near the critical limit and to improve the breaking efficiency.

In these the second to the fourth embodiments, the relation between the number N of the conduction studs of small diameter and the diameter D (mm) of the electrode can be set as 0.05 D<N and as a result, it becomes possible to restrain the spatial fluctuation of flux and to let the arc break out uniformly over the surface of the contact element. Further, in the second to the fourth embodiments, as to each two conduction stud 21 or conduction stud 24 locating at both sides of each magnetic member 22 or each projection 25*a* of the magnetic member 25, by setting respective distances between the stud 21 and the magnetic member 22 or between the stud 24 and the projection 25*a* to differ each other, the flux. produced around the conduction stud located at the nearer side by the current flowing therethrough tends to mainly pass through each magnetic member 22 or each projection 25*a* and, the affection from the flux of the reverse direction produced around the conduction stud located at the farther side by the current flowing therethrough is restrained. Therefore, the intensity of the magnetic pole appearing at each end of the magnetic member is strengthened and the high axial flux density is available.

Industrial Applicability

As set forth above, according to the invention claimed in claims 1 to 4, the distribution of current density in the arc is unified and the critical current value causing the arc concentration is improved.

According to the invention claimed in claims 5 and 6, even if the arc concentration occurs because of reaching the current density between the electrodes to the critical current value, it becomes possible to make the arc concentrate to plural circumferentially dispersed points on the circumferential area of the electrode so that the current density is lowered at each arc concentrating point in comparison with the conventional electrode in which the arc tends to concentrate to one point and accordingly, the damages to the electrode are lessened and the breaking limit current can be raised.

According to the invention claimed in claim, by using the contact element of graded characteristic where the material of the contact element is adjusted so as the cathode voltage drop to be continuously or gradually lowered from the center area to the circumferential area, the arc concentration to the center of the electrode is prevented and the distribution of current density in the arc is unified over the whole surface of the electrode and as a result, the critical current value of the arc concentration is improved and the breaking efficiency is raised.

According to the invention claimed in claims 8 to 9, by providing a plurality of magnetic field producing means on the circumferential area of the electrode, even if the arc concentration occurs because of reaching the current density between the electrodes to the critical current value, it becomes possible to make the arc concentrate to plural circumferentially dispersed points on the circumferential area of the electrode so that the current density is lowered at each arc concentrating point in comparison with the conventional electrode in which the arc tends to concentrate to one point and accordingly, the damages to the electrode are lessened and the breaking limit current can be raised.

What is claimed is:

1. A vacuum valve, comprising:

a stationary electrode and a movable electrode, said stationary electrode facing said movable electrode, wherein each of said movable and stationary electrodes comprises:

a contact element having a circular shape, and a conduction column having a circular-shaped top surface facing a bottom surface of said contact element, and said conduction column including;

a plurality of conduction studs positioned along peripheral locations on said circular-shaped top surface, and a plurality of U-shaped magnetic members disposed respectively around said conduction studs in order that each magnetic member is magnetized by a magnetic field produced around the respective conduction studs and in which mutually opposite magnetic poles appear at respective open ends of each magnetic member when an electric current axially flows through each of the conduction studs.

2. The vacuum valve according to claim 1, wherein said conduction studs are positioned at a point of 90% of a radius away from a center point on said circular-shaped top surface of said conduction column, with respect to a point on said periphery of said circular-shaped top surface of said conduction column.

3. The vacuum valve according to claim 1, wherein a radial distribution of axial magnetic flux densities parallel to an arc produced between the moveable and stationary electrodes upon separation increases radially outward from a center area of the contact element, a portion giving a maximum value (Bp) of the axial flux densities being located at a location of and beyond 70% of a radius of the contact element, and the maximum value (Bp) of the axial flux densities along an arbitrary radius of the contact element being 1.4 to 2.4 times greater than an axial flux density of the center area (Bct) of the contact element.

4. The vacuum valve according to claim 1, wherein a radial distribution of axial magnetic flux densities parallel to an arc produced between the moveable and stationary electrodes upon separation increases radially outward from a center area of the contact element, a portion giving a maximum value (Bp) of the axial flux densities being located at a location of and beyond 70% of a radius of the contact element, and the maximum value (Bp) of the axial flux densities along an arbitrary radius of the contact element being 1.05 to 2.16 times grater than an axial flux density (Bcr) which is produced when an arc voltage becomes minimum (Vmin) according to a relationship between the arc voltage and the axial flux densities.

5. A vacuum valve, comprising:

a stationary electrode and a moveable electrode, said stationary electrode facing said moveable electrode, wherein each of said moveable and stationary electrodes comprises:

a contact element having a circular shape, and a conduction column having a circular-shaped top surface facing a bottom surface of said contact element, said conduction column including;

a plurality of conduction studs positioned along peripheral locations on said circular-shaped top surface, and a magnetic member disposed between the bottom surface of said contact element and said circular-shaped top surface of said conduction column, said magnetic member including a circular-shaped middle portion with a plurality of projections which extend from respective portions of said circular-shaped middle portion to each of said conduction studs to partially surround each of them in order that each projection is magnetized by a magnetic field produced around the respective conduction studs and in which a magnetic pole appears at an open end of each projection when an electric current axially flows through each of the conduction studs.

6. The vacuum valve according to claim 5, wherein said conduction studs are positioned at a point of 90% of a radius away from a center point on said circular-shaped top surface of said conduction column, with respect to a point on said periphery of said circular-shaped top surface of said conduction column.

7. The vacuum valve according to claim 5, wherein said circular-shaped middle portion of said magnetic member has a center hole which is disposed to be below a center region of said contact element.

8. The vacuum valve according to claim 5, wherein a radial distribution of axial magnetic flux densities parallel to an arc produced between the moveable and stationary electrodes upon separation increases radially outward from a center area of the contact element, a portion giving a maximum value (Bp) of the axial flux densities being located at a location of and beyond 70% of a radius of the contact element, and the maximum value (Bp) of the axial flux densities along an arbitrary radius of the contact element being 1.4 to 2.4 times greater than an axial flux density of the center area (Bct) of the contact element.

9. The vacuum valve according to claim 5, wherein a radial distribution of axial magnetic flux densities parallel to an arc produced between the moveable and stationary electrodes upon separation increases radially outward from a center area of the contact element, a portion giving a maximum value (Bp) of the axial flux densities being located at a location of and beyond 70% of a radius of the contact element, and the maximum value (Bp) of the axial flux densities along an arbitrary radius of the contact element being 1.05 to 2.16 times greater than an axial flux density (Bcr) which is produced when an arc voltage becomes minimum (Vmin) according to a relationship between the arc voltage and the axial flux densities.

10. The vacuum valve according to claim 5, wherein each of the plurality of projections extends directly outwards with respect to a center point of the circular-shaped middle portion of said magnetic member.

* * * * *